US005478050A

United States Patent [19]

Ott

[11] Patent Number: 5,478,050

[45] Date of Patent: Dec. 26, 1995

[54] LUMBER COMPENSATION DEVICE

[76] Inventor: George C. Ott, 181 Tanglewilde Rd., Lake Peekskill, N.Y. 10537

[21] Appl. No.: 225,772

[22] Filed: Apr. 11, 1994

[51] Int. Cl.[6] ..... B66F 3/00

[52] U.S. Cl. ..... 254/17

[58] Field of Search ..... 254/11–17; 81/489

[56] References Cited

U.S. PATENT DOCUMENTS

| | | | |
|---|---|---|---|
| 832,516 | 10/1906 | Williams | 254/17 |
| 4,821,784 | 4/1989 | Cone | 254/17 |
| 5,269,494 | 12/1993 | Pittman et al. | 254/17 |
| 5,359,911 | 11/1994 | Kruesi | 81/489 |

FOREIGN PATENT DOCUMENTS

| | | | |
|---|---|---|---|
| 401775 | 11/1933 | United Kingdom | 254/17 |

*Primary Examiner*—Robert C. Watson

[57] ABSTRACT

A lumber compensation device including a lever operated pivoting cam engaging the lumber wherein the cam is affixed to an underlying joist. The cam is affixed to the joist by an elongated toothed member and a U shaped clamp which preclude translational motion of the device. Rotational motion applied to the lever engages the cam with the lumber and further lever rotation forces the lumber into desired conformance after which the lumber is nailed in place. The lumber compensation device is operated by a single individual who is enabled in the performance of nailing the lumber while the device hold the lumber in place.

4 Claims, 3 Drawing Sheets

LUMBER COMPENSATION DEVICE

BACKGROUND OF THE INVENTION

1. Field of the Invention

The present invention relates to devices providing compensation of lumber to remove lateral warping and similar defects during the installation process and more particularly pertains to the straightening of individual planks employed as a deck surface wherein the straightening is performed while a plank is being affixed to underlying joists.

2. Description of the Prior Art

The use of lumber compensation devices is known in the prior art. More specifically, lumber compensation devices heretofore devised and utilized for the purpose of recovering lumber to a particular straightness are known to consist basically of familiar, expected and obvious structural configurations, notwithstanding the myriad of designs encompassed by the crowded prior art which have been developed for the fulfillment of countless objectives and requirements.

The present invention is directed to improving devices for lumber compensation in a manner which is safe, secure, economical and aesthetically pleasing.

For example, U.S. Pat. No. 4,821,784 to Cone discloses a tool for removing lateral deflection in a wood plank comprising a lever having a fulcrum member affixed to an underlying joist, an elongated arm portion to which restoring force is applied by a human, and a short length force application portion engaging the deflected plank. The Cone invention employs the mechanical advantage of a fixed radius lever to force the plank into an acceptable degree of straightness and requires a substantially elongated lever arm to which force is applied. And in most cases the applied force must be maintained by continued human interaction with the lever throughout the nailing process. The present invention comprises a continuous cam manually driven by an attached lever wherein the cam rotational axis is affixed to an underlying joist. The cam of the present invention is designed to reposition the deflected plank in varying proportion to the rotational position of the attached lever and thereby providing more controlled application of straightening force. And furthermore, the present invention enables the plank installer to apply straightening force and leave the device unattendedly maintaining the force during nailing.

In U.S. Pat. No. 5,181,703 to Gilstad et al. an apparatus for installing wooden decking is disclosed. The Gilstad et al. apparatus comprises a pneumatically energized actuator having a series of clamps and spacers which provide for alignment and relative spacing of one plank with respect to another for the purpose of nailing. The Gilstad et al. invention is a complicated machine requiring a significant monetary investment and an incidental air compressor for operation, and therefore is generally limited to the professional construction marketplace. And furthermore, the Gilstead et al. apparatus, being more or less designed for plank positioning, may be unable to apply adequate force to restore a warped plank. The present invention is of inexpensive construction not requiring a supply of compressed air for operation and therefore is well suited for a range of construction levels of involvement including the fundamentally equipped novice and the professional builder. The present invention is capable of applying a substantial force to the plank thereby enabling correction of warpage in lumber pieces which may be discarded in use of the Gilstad et al. invention.

In U.S. Pat. No. 4,850,114 to Vockins a decking spacer is described. The Vockins spacer has only a provision for providing a correct spacing of adjacent deck planks but omits a means for forcing warped planks into conformance prior to nailing. The present invention provides a means for correcting warpage and may be used in conjunction with the Vockins device.

In U.S. Pat. No. 3,779,515 to Larios et al. an adjustable decking and framing tool is disclosed for performing a variety of functions one of pertinence being to move deck boards into position on their supporting joists. A disadvantage in this prior art lies in a lack of a provision for leaving the tool unattended and having the deck plank under adjustment remain positioned for nailing. The present invention maintains the plank in corrected position for nailing without attention to the device.

U.S. Pat. No. 4,046,362 to Spillers discloses a board holding device. The disclosure teaches an apparatus for clamping a plurality of boards for subsequent breaking in the martial arts such as karate. The disclosure makes no provision for applying corrective force to planks during installation and is ill suited for such application in having an ability to apply force to boards solely at their respective ends. The present invention employs a single force application device and is directly suitable for rendering warped decking planks straight as required for nailing.

In this respect, the lumber compensation device according to the present invention substantially departs from the conventional concepts and designs of the prior art, and in so doing provides an apparatus primarily developed for the purpose of correcting curvature in planks during installation.

Therefore, it can be appreciated that there exists a continuing need for new and improved lumber compensation device which can be employed by the novice and expert alike to rapidly and with minimal effort compensate the curvature of planking thereby providing for the desired linear installation. In this regard, the present invention substantially fulfills this need.

As illustrated by the background art, efforts are continuously being made in an attempt to improve lumber compensation devices. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of lumber compensation devices now present in the prior art, the present invention provides an improved lumber compensation device construction wherein the same can be utilized for maintaining straightness of planking during installation As such, the general purpose of the present invention, which will be described subsequently in greater detail, is to provide a new and improved lumber compensation device apparatus and method which has all the advantages of the prior art lumber compensation devices and none of the disadvantages.

The invention is defined by the appended claims with the specific embodiment shown in the attached drawings. For the purpose of summarizing the invention, the invention may be incorporated into a hand operated device comprising a cam having an attachment which affixes the cam rotational axis to an underlying joist, and a hand operated lever affixed to the cam rotationally disposes the cam against a plank requiring correction and, being further rotated, applies corrective forces wherein the plank is nailed in place.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an improved lumber compensation device.

It is therefore an additional object of the present invention to provide a new and improved lumber compensation device which has all the advantages of the prior art lumber compensation devices and none of the disadvantages.

It is another object of the present invention to provide a new and improved lumber compensation device which may be easily and efficiently manufactured and marketed.

It is a further object of the present invention to provide a new and improved lumber compensation device which is of a durable and reliable construction.

An even further object of the present invention is to provide a new and improved lumber compensation device which is susceptible of a low cost of manufacture with regard to both materials and labor, and which accordingly is then susceptible of low prices of sale to the consuming public, thereby making such lumber compensation devices economically available to the buying public.

Still yet another object of the present invention is to provide a new and improved lumber compensation device which provides in the apparatuses and methods of the prior art some of the advantages thereof, while simultaneously overcoming some of the disadvantages normally associated therewith.

Still another object of the present invention is to provide a new and improved device which permits manual correction of an inappropriatiately curved plank and subsequent nailing by a single worker.

Yet another object of the present invention is to provide a new and improved lumber compensation device which has a diminishing lateral displacement of a lumber member under correction with rotation of an operating lever.

Even still another object of the present invention is to provide a new and improved lumber compensation device requiring only manually applied forces to correct substantial lateral warpage in decking lumber during the installation process.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
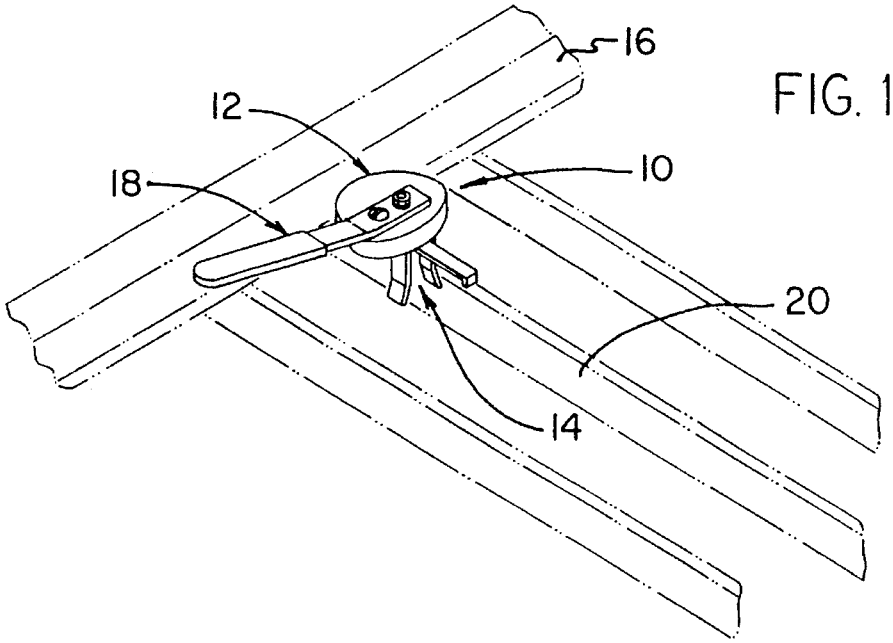
FIG. 1 is a right perspective view of the lumber compensation device showing the operational disposition of the device.

With reference now to the drawings, and in particular to FIG. 1 thereof, a new and improved lumber compensation device embodying the principles and concepts of the present invention and generally designated by the reference numeral 10 will be described.

From an overview standpoint, the lumber compensation device 10 is adapted for use by humans to engage and effectively correct objectionable lateral curvature of decking lumber during the installation process. See FIG. 1. Lumber compensation device 10 comprises a lever operated cam 12 rotatable affixed to a joist engagement member 14. Cam 12 engages lumber member 16 by manually induced rotation of lever 18. Joist engagement member 14 maintains the position of cam 12 by engaging joist 20.

Figure 2:
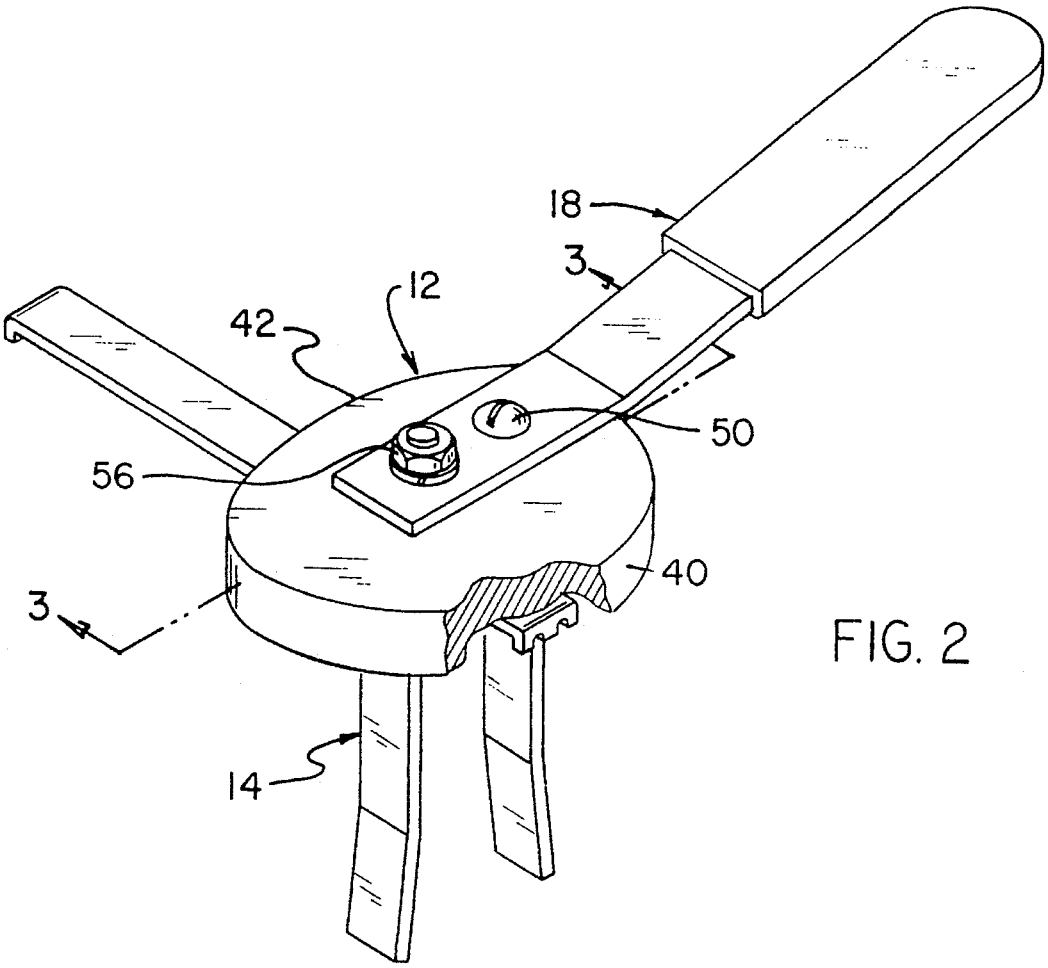
FIG. 2 is a left perspective view of the lumber compensation device in a pre-installation position.

More specifically, it will be noted that the lumber compensation device 10 comprises a cam 12 rotationally disposed about an axis affixed to joist engagement member 14 by application of human force to lever 18. Cam 12 is a substantially planar ellipsoid rotating about an axis which may or may not be centrally located. See FIG. 2. And furthermore, cam 12 may depart from an ellipsoidal shape in having a substantially greater radial dimension on portion 40 than on portion 42 thereby providing more corrective displacement for a given rotation of lever 18, wherein the displacement is dependent upon which portion engages lumber member 16.

Figure 3:
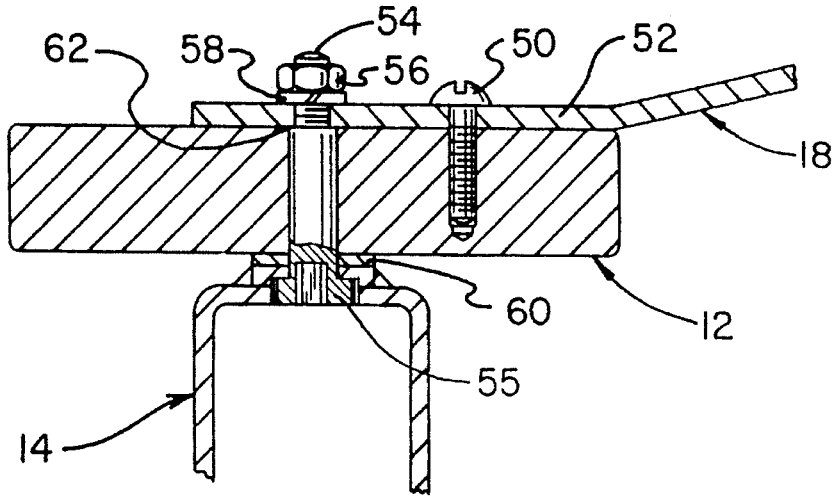
FIG. 3 is a fragmentary side sectional view of the lumber compensation device taken substantially upon the plane indicated by the section line 3—3 of FIG. 2.
Figure 4:
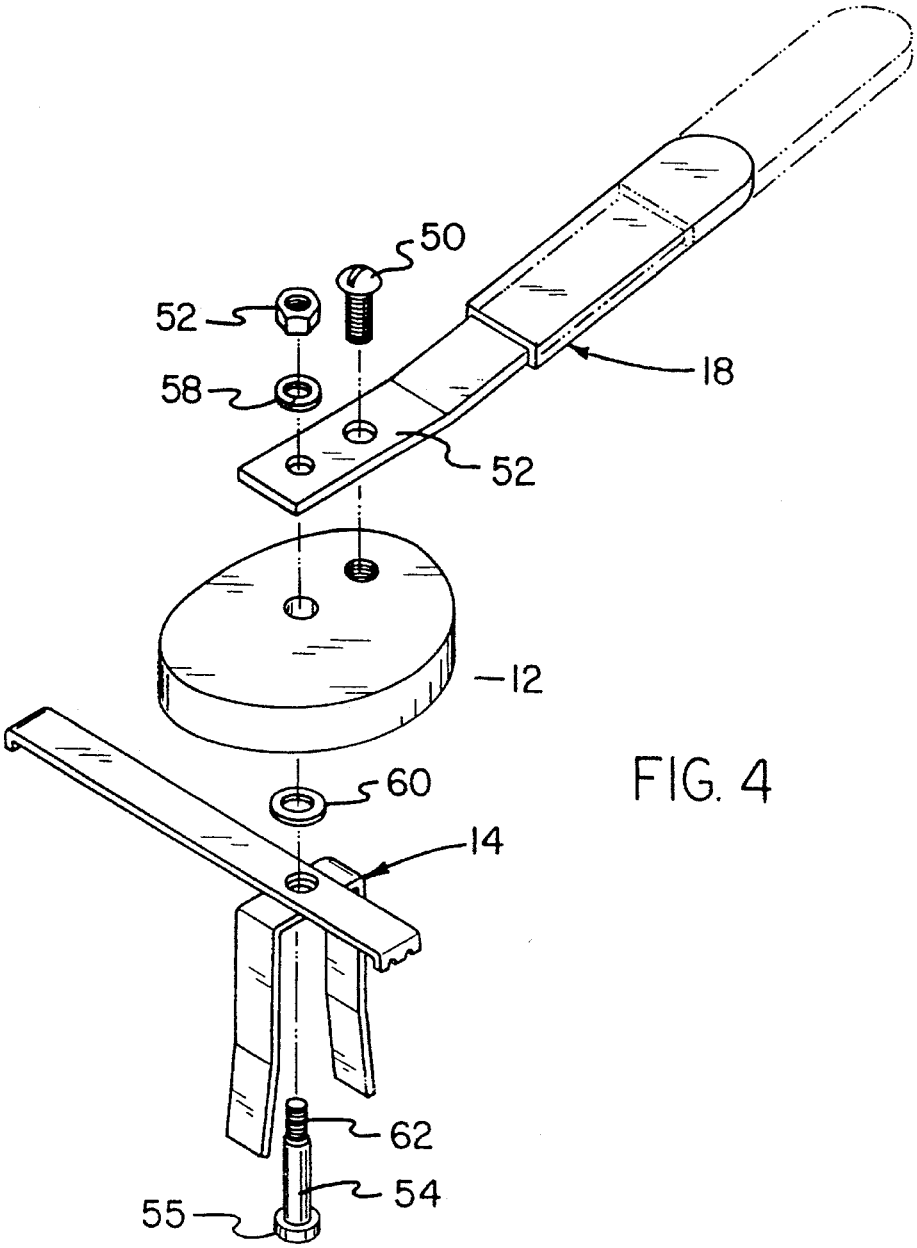
FIG. 4 is an exploded left perspective view of the lumber compensation device.

Cam 12 may also be effectively configured as a circular plate having an eccentric rotation axis. Lever 18 is perforated in two places in lever first portion 52 is affixed to cam 12 by bolt 50 which threadedly engages cam 12 and shoulder bolt 54, said shoulder bolt 54 in simultaneity being an axle member about which cam 12 is free to rotate. See FIGS. 3 and 4. Cam 12 and lever 18 are held in position by nut 56 threadedly engaging shoulder bolt 54. Flat washer 60 acts as a thrust bearing being interdisposed between cam 12 and joist engagement member 14.

Figure 5:
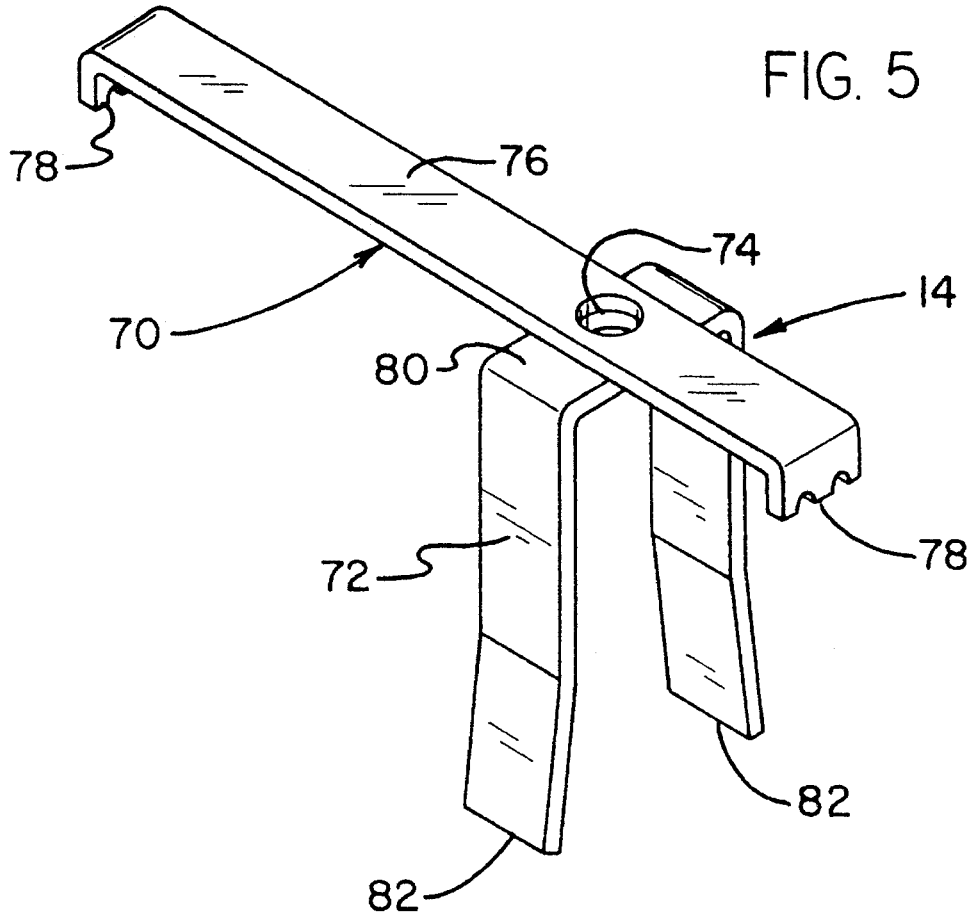
FIG. 5 is a fragmentary perspective view of a lumber compensation device showing a means for engaging underlying joists.

Lockwasher 58 is interdisposed between nut 56 and lever first portion 52 thereby affixing shoulder bolt 54 to lever first portion 52 by frictional engagement of the shoulder portion 62 of shoulder bolt 54 and lever first portion 52. Shoulder bolt 54 must therefore be free to rotate in joist engagement member 14. Shoulder bolt 54 has head portion 55 recessed within joist engagement member 14 thereby producing a substantially planar joist engagement surface. Head portion 55 may employ an internal hex or Allen spline, or a Bristol spline, or a number of alternate means for engaging a tool for performance of a tightening operation upon shoulder bolt 54. FIG. 5 shows the joist engagement member 14 comprising an elongated toothed engagement portion 70 and a lateral spring clamp 72.

Lever second portion 53 comprises an extension of lever first portion 52 being disposed at a slight angle thereto. Telescoping handle member 64 comprises an elongated extension of lever second portion 53 and is slidably engaged thereon. A stopping means is provided to preclude disengagement of the telescoping handle member 64 from lever second portion 53. And furthermore, one or more detents may be provided to releasably stop telescoping handle member 64 at various position of extension. Telescoping handle member 64 is most useful when cam member 12 comprises a discoid having two differing curved cam portions 40 and 42.

Elongated toothed portion 70 and lateral spring clamp 72 are co-joined at shoulder bolt through hole 74 by using single piece or welded construction, or by casting a single part. Elongated toothed engagement portion 70 comprises a flattened elongate central portion 76 terminating at the two most separate ends in orthogonal teeth 78 disposed toward the lateral spring clamp 72. Shoulder bolt through hole 74 perforates elongate central portion 76 at a site nearer to one set of orthogonal teeth 78 than complimentary orthogonal teeth 78.

The actual nearer linear distance is established as being no greater than the most minor radius of the cam 12. Lateral spring clamp 72 comprises a U shaped member having a flattened portion 80, being perforated by shoulder bolt through hole 74, and two equal length opposing legs 82 being substantially perpendicularly disposed with respect to flattened portion 80. Legs 82 are parallel or directed slightly toward one another over a substantial portion of their length beginning at a junction with flattened portion 80.

Near the free end of legs 82 there is some widening of the interleg spacing to facilitate attachment of the lumber compensation device 10 to joist member 20. When operationally disposed lateral spring clamp member 72 frictionally engages the sides of joist member 20 preventing twisting or lateral movement of the lumber compensation device 10 and elongated toothed engagement member 70 engages the deck attachment portion of joist 20 by digging into the joist 20 material.

Figure 6:
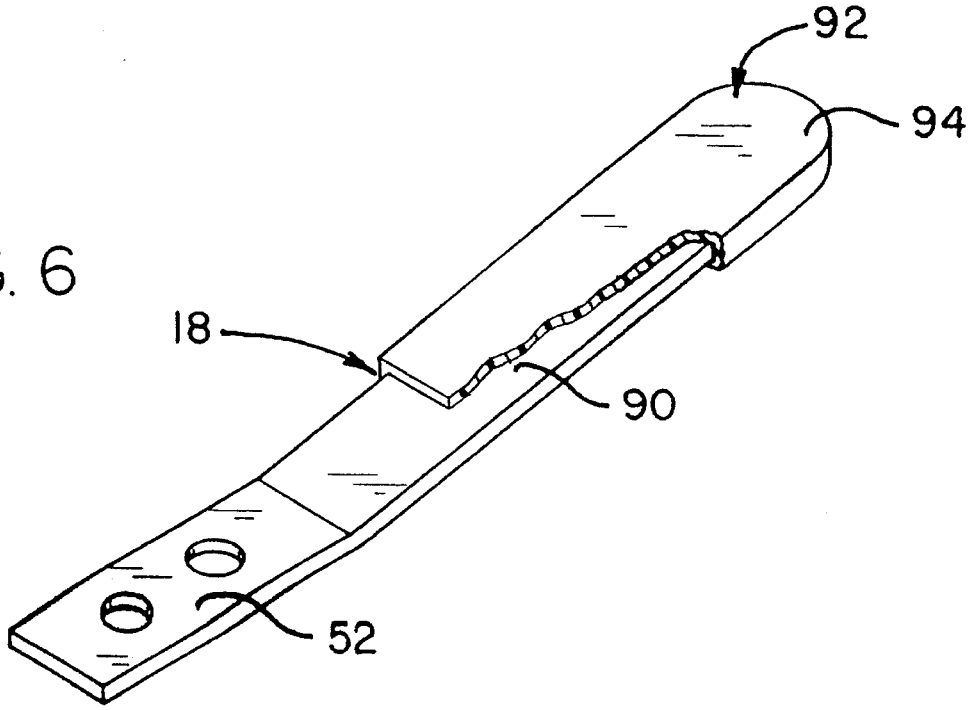
FIG. 6 is a fragmentary perspective view of a lumber compensation device showing a lever means for operation of the device.

A simplified embodiment of lever 18 comprises a previously described lever first portion 52, a lever second portion 90, and a sheath 94. See FIG. 6. Lever second portion 90 comprises a flattened elongated extension of lever first portion 52 being disposed at a slight angle to the lever first portion 52 and terminating in a smoothly rounded free end 92. Free end 92 and a portion of lever second portion 53 are covered by a polymeric sheath 94 providing the advantage of protection of human hands, aesthetic appeal, and provision of a superior grip surface. Sheath 94 may be applied by a dipping technique, as an adhering tape, or as a frictionally engaging slip on cap. Telescoping handle member 64 may also be covered by a substantially similar sheath.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by LETTERS PATENT of the United States is as follows:

1. A new and improved lumber compensation device for correcting curvature in lumber while undergoing installation as deck planking comprising:

a pivoting cam having an axle member translationally affixed to a stationary underlying joist wherein said cam engages the lumber, a handle affixed to said cam in which said handle comprises a substantially flattened elongated member having a first handle portion perforated for passage of bolts affixing said flattened elongated member to the cam, a second handle portion comprising an extension of said first handle portion being disposed at a small angle to said first handle portion, and a polymeric covering adherent to a portion of said second handle portion and wherein rotation of said handle correspondingly rotates said cam, and an axle affixing means which secures said axle member to said underlying joist.

2. The new and improved lumber compensation device of claim 1 in which said cam comprises a substantially circular plate having a rotational axis located at a position anywhere therethrough except said rotational axis cannot be located at a geometric center of said plate.

3. The new and improved lumber compensation device of claim 1 in which said cam comprises a plate having a multiplicity of flat portions for engaging said lumber member thereby the lumber compensation device is self maintained in one of several engagement positions.

4. The new and improved lumber compensation device of claim 1 in which said axle affixing means further comprises:

a lateral spring clamp having substantially orthogonal elongated legs and a flattened central portion to thereby form a first U shaped member, and an elongated toothed portion having a flattened elongated central portion with orthogonally disposed teeth at both of the maximally separated free ends thereof to thereby form a second U shaped member and with said teeth of the second U shaped member being substantially shorter than said elongated central portion thereof, and furthermore said elongated central portion of said second U shaped member has a through hole engaging a shoulder bolt affixed to said cam, and with said second U shaped member being rigidly joined to said first U shaped member such that the legs of the first U shaped member and the teeth of the second U shaped member are extending in substantially the same direction.

* * * * *